US009364039B2

(12) United States Patent
Pusateri

(10) Patent No.: US 9,364,039 B2
(45) Date of Patent: Jun. 14, 2016

(54) DEVICE FOR PROVIDING PROTECTION AGAINST MINOR HEAD INJURY AND FOR STABILIZING A HAT

(71) Applicant: Julie A. Pusateri, Burr Ridge, IL (US)

(72) Inventor: Julie A. Pusateri, Burr Ridge, IL (US)

( * ) Notice: Subject to any disclaimer, the term of this patent is extended or adjusted under 35 U.S.C. 154(b) by 0 days.

(21) Appl. No.: 14/658,296

(22) Filed: Mar. 16, 2015

(65) Prior Publication Data

US 2015/0305423 A1 Oct. 29, 2015

Related U.S. Application Data

(60) Provisional application No. 61/985,594, filed on Apr. 29, 2014.

(51) Int. Cl.

| | |
|---|---|
| ***A42B 1/00*** | (2006.01) |
| ***A42B 1/08*** | (2006.01) |
| *A42B 1/06* | (2006.01) |

(52) U.S. Cl.

CPC . *A42B 1/08* (2013.01); *A42B 1/002* (2013.01); *A42B 1/069* (2013.01)

(58) Field of Classification Search

CPC ..... A42B 3/00; A42B 1/002; A42B 1/069; A42B 3/10; F16M 13/06

USPC ..... 2/2.5, 421, 182.2, 175.4, 195.5, 410, 2/411, 412, 413, 414, 425

See application file for complete search history.

(56) References Cited

U.S. PATENT DOCUMENTS

| | | | | |
|---|---|---|---|---|
| 3,153,792 A * | 10/1964 | Marietta | ..... | A42B 3/127 2/414 |
| 5,647,064 A * | 7/1997 | Whittaker | ..... | A42B 1/002 2/175.4 |
| 2007/0163031 A1* | 7/2007 | Lewis, Jr. | ..... | A42B 3/127 2/414 |

FOREIGN PATENT DOCUMENTS

| | | | | |
|---|---|---|---|---|
| IT | EP 0613625 A1 * | 9/1994 | ..... | A42B 3/10 |

* cited by examiner

*Primary Examiner* — Robert J Hicks
*Assistant Examiner* — Heather Mangine
(74) *Attorney, Agent, or Firm* — Justin Lampel

(57) ABSTRACT

A device for providing protection against minor head injury and for stabilizing a hat is provided. The device moves from a generally flat first orientation into a domed-shaped second orientation. In the second orientation, the device is placed under the underside of a hat and supports the hat in an upright position. The device may be placed under a hat for protection and/or to store the hat in an upright position for display and to reduce the sagging of the hat over time. Further, the device may be placed under a hat and the hat worn. The device has a plurality of radially extending arms extending from a center portion. The perimeter surface of the device may be partially inserted within a groove of the hat so as to allow the device to remain secured within the hat. The device is also suitable for providing some protection against head injury when the device is properly worn under a hat.

5 Claims, 6 Drawing Sheets

DEVICE FOR PROVIDING PROTECTION AGAINST MINOR HEAD INJURY AND FOR STABILIZING A HAT

CROSS REFERENCE TO RELATED APPLICATIONS

The following application is based on and claims the priority benefit of U.S. provisional application Ser. No. 61/985,594 filed Apr. 29, 2014; the entire contents of which are incorporated by reference.

BACKGROUND OF THE INVENTION

A device for providing protection against minor head injury and for stabilizing a hat is provided. The device moves from a generally flat first orientation into a domed-shaped second orientation. In the second orientation, the device is placed under the underside of a hat and supports the hat in an upright position. The device may be placed under a hat for protection and/or to store the hat in an upright position for display and to reduce the sagging of the hat over time. Further, the device may be placed under a hat and the hat worn. The device has a plurality of radially extending arms extending from a center portion. The perimeter surface of the device may be partially inserted within a groove of the hat so as to allow the device to remain secured within the hat. The device is also suitable for providing some protection against head injury when the device is properly worn under a hat.

Liners for hats have been invented in the past. For example, U.S. Pat. No. 5,566,395 to Nebeker discloses a disposable liner which is fitted against the inside surface of a sweatband of a cap or hat. The liner functions to absorb moisture and oils, and to eliminate odor. The liner wicks moisture away from a user and may hold moisture away from the hat. The liner may wick moisture to an evaporation region to be evaporated. The evaporation region may be separated from the hat by a cover layer to prevent wicking into the crown of the hat. The liner may be configured to adjust the size, and thus the fit of the hat on the head of the user. To secure a hat on the head of a user, the liner may include a compressible, foamed, polymeric core. The core may be treated with an antibacterial agent and a deodorizing agent for eliminating odors. To one side of the core is attached an adhesive layer for securing the same to the sweatband of the hat. The adhesive is selected for firmness yet easy removal and disposal of the liner. The adhesive may be heat-sensitive. Multiple layers of foamed polymeric substrates coated on two sides with adhesive may be adhered to one another for sizing a hat. The other side of the core is bonded to a fabric layer positionable against the forehead of a user. The fabric layer may be formed to have an absorbent layer, and may include a non-absorbent outer layer that transfers moisture but remains dry to the touch.

Further, U.S. Pat. No. 5,022,095 to Fleury discloses an inexpensive, disposable liner for hard hats. The liner is shaped to be inserted into and resiliently engage the lower periphery of a hard hat. The liner includes an elastic band attached to the lower edge of the liner so that the liner can be slipped over the beak and the interior support of the hard hat. The liner is preferably made of a soft, breathable material which will prevent the buildup of moisture, and which will feel comfortable to the user. The sides of the liner are elongated so that the liner can be folded over the lower periphery of the hard hat. The elastic band attached to the lower edge of the liner allows the liner to be easily installed into and removed from the hard hat.

Still further, U.S. Pat. No. 5,313,668 to Bogan discloses a liner for a hat, cap or similar head covering having a layer of moisture absorbent material which is backed by a layer of moisture impervious material. Further, adhesive means are provided for releasably securing the liner to the sweatband of the hat, cap or similar headgear. The bottom and side edges of the moisture absorbing layer are sealed to prevent the migration of moisture, oil, grease and other contaminants through these edges of the liner. The upper edge of the liner is left unsealed so that a wicking action encourages the transport of moisture from the body of the moisture absorbing layer to the top edge where it may be evaporated.

However, these patents fail to describe a device for protecting against minor head injury and for stabilizing a hat in which the device moves from a first orientation into a second orientation and which is easy to use. Further, these patents fail to provide for a device for protecting against minor head injury and for stabilizing a hat which allows a hat to be displayed without the hat sagging.

SUMMARY OF THE INVENTION

A device for providing protection against minor head injury and for stabilizing a hat is provided. The device moves from a generally flat first orientation into a domed-shaped second orientation. In the second orientation, the device is placed under the underside of a hat and supports the hat in an upright position. The device may be placed under a hat for protection and/or to store the hat in an upright position for display and to reduce the sagging of the hat over time. Further, the device may be placed under a hat and the hat worn. The device has a plurality of radially extending arms extending from a center portion. The perimeter surface of the device may be partially inserted within a groove of the hat so as to allow the device to remain secured within the hat. The device is also suitable for providing some protection against head injury when the device is properly worn under a hat.

An advantage of the present device for stabilizing a hat is that the present device may provide some protection against an injury which might otherwise be sustained if the user is not wearing the device.

And another advantage of the present device is that, in an embodiment, the present device may be waterproof.

Yet another advantage of the present device is that the present device may be suitable for providing some protection to children and adults from head collisions obtained by participating in light contact sports.

Still another advantage of the present device is that the present device may be suitable for providing some protection to the head of the person wearing the device during a fall.

And another advantage of the present device for stabilizing a hat is that the device allows a hat to be displayed in an upright position when the hat is not worn.

Still another advantage of the present device for stabilizing a hat is that the device may be reused on numerous hats.

Another advantage of the present device for stabilizing a hat is that the device may be used in a manner so as to allow a user to wear a hat which is larger than the wear's normal hat size.

Yet another advantage of the present device for stabilizing a hat is that the present device may be used to prevent sagging of the hat so as to prolong the life of the hat.

Still another advantage of the present device for stabilizing a hat is that the device may be used in connection with various sized hats.

And another advantage of the present device for stabilizing a hat is that the present device may be stored and transported in a generally flat orientation and only converted into the second orientation just prior to use.

Another advantage of the present device for stabilizing a hat is that the present device is easy to clean.

Yet another advantage of the present device for stabilizing a hat is that the present device is comfortable to wear under a hat.

Still another advantage of the present device for stabilizing a hat is that the present device has a hole for allowing the device to be hung from a wall or from a sales rack when not in use.

And another advantage of the present device is that the present device has a plurality of holes for allowing air to circulate to the head of a wear therein preventing over-heating.

Yet another advantage of the present device is that the present device makes larger hats and helmets fit better when worn by a child or adult.

Still another advantage of the present device is that the present device provides a barrier between a person's head and, for example, a rental helmet, therein increasing sanitation.

For a more complete understanding of the above listed features and advantages of the device for stabilizing a hat reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A device for providing protection against minor head injury and for stabilizing a hat is provided. The device moves from a generally flat first orientation into a domed-shaped second orientation. In the second orientation, the device is placed under the underside of a hat and supports the hat in an upright position. The device may be placed under a hat for protection and/or to store the hat in an upright position for display and to reduce the sagging of the hat over time. Further, the device may be placed under a hat and the hat worn. The device has a plurality of radially extending arms extending from a center portion. The perimeter surface of the device may be partially inserted within a groove of the hat so as to allow the device to remain secured within the hat. The device is also suitable for providing some protection against head injury when the device is properly worn under a hat.

Figure 1:
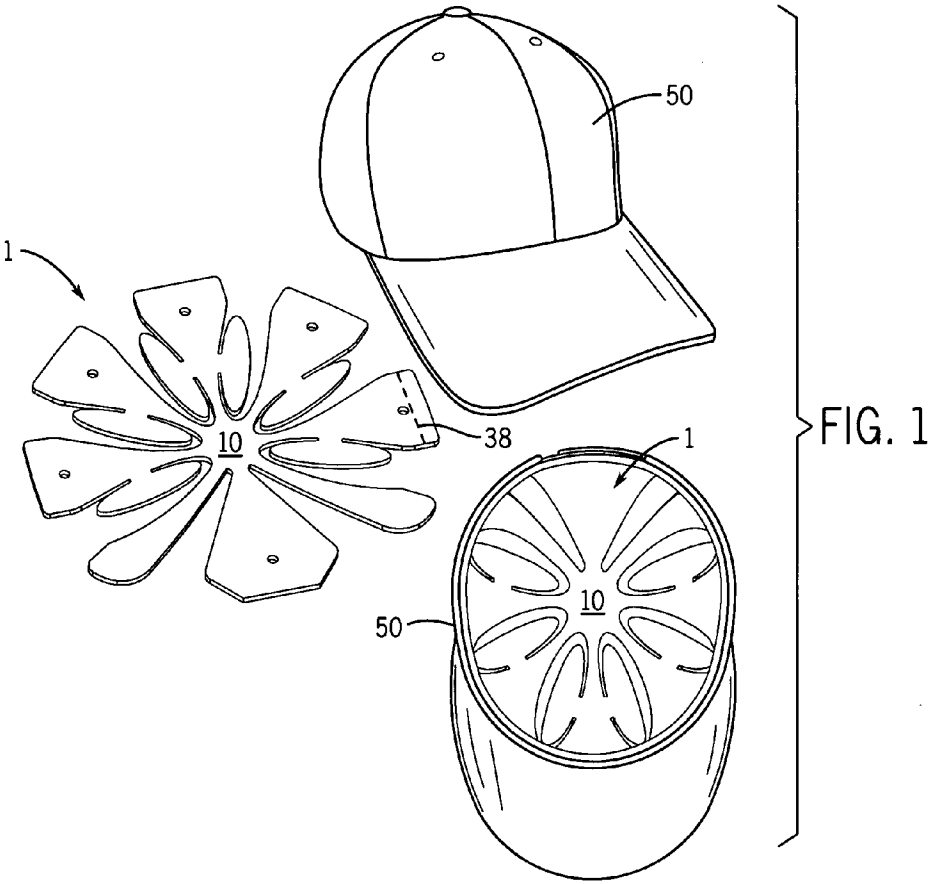
FIG. 1 illustrates a view of the device in a generally flat orientation as well as images of the device inserted into the underside of a hat.
Figure 2:
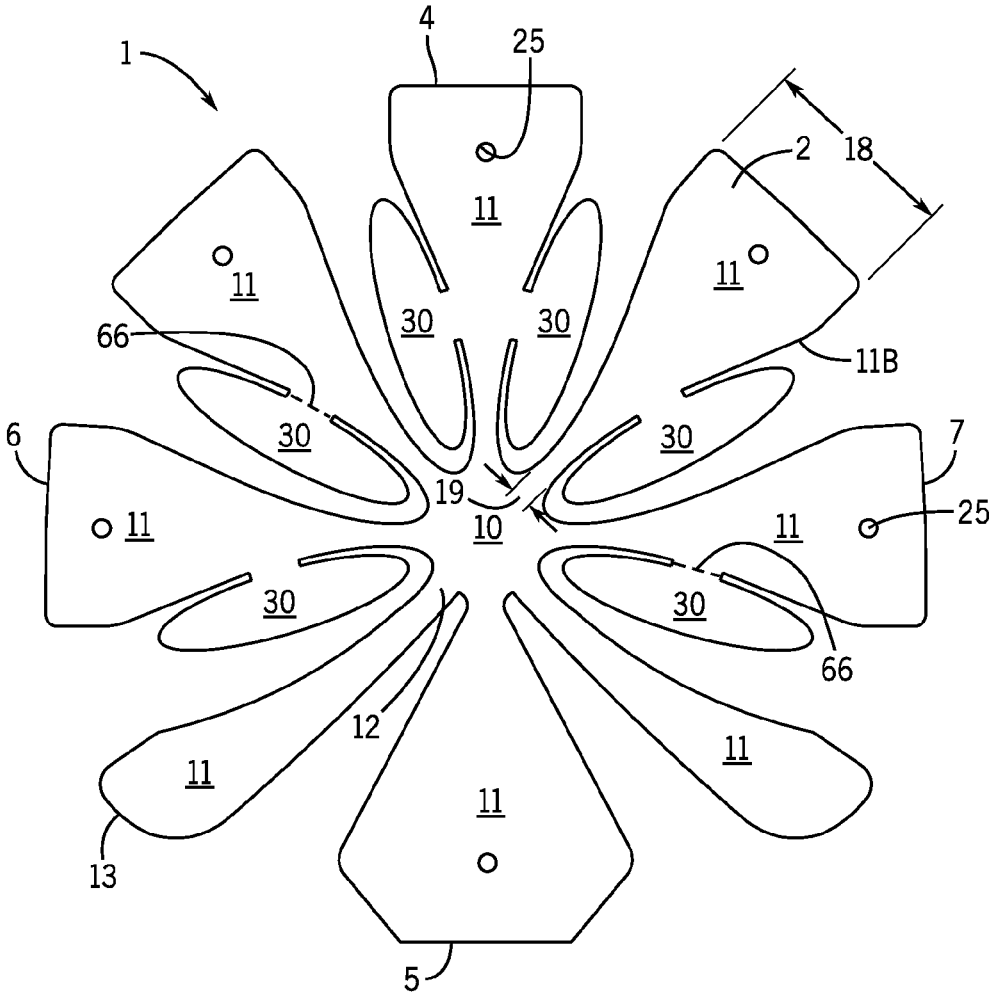
FIG. 2 illustrates a top view of the device in the generally flat orientation.

Referring first to FIG. 2, in an embodiment a device 1 for stabilizing a hat 50 (FIG. 1) is provided. The device 1 may be a "liner" preferably made from a generally rigid but malleable foam, cardboard, rubber or the like. It should be noted that the device 1 may be made of various other materials depending on the desired specific application for the device 1. In an embodiment, the device 1 may be waterproof or may be absorbent so as to soak up sweat of the person wearing the device 1.

Figure 3:
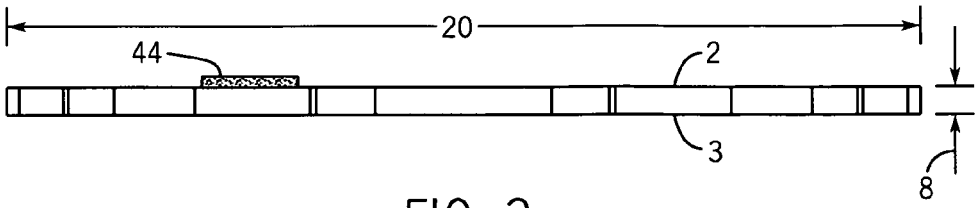
FIG. 3 illustrates a side view of the device for stabilizing a hat wherein the device is in the non-functional flat orientation.

In an embodiment, the device 1 may have a top 2, a bottom 3 (FIG. 3), a front 4, a back 5, a first side 6, a second side 7 and a width 8 or thickness (FIG. 3). Preferably, the device 1 is generally snow-flake shaped. In particular, the device 1 may have a center ring portion 10 and a plurality of outwardly extending arms 11. The figures illustrate eight outwardly extending main arms 11; however, a fewer or a greater number of outwardly extending main arms 11 may be utilized. Because the device 1 acts as a padded surface suitable for protecting the user against certain blows to the head, it is desirable that the outwardly extending main arms 11 occupy as large of a surface area under the underside 51 (FIG. 6) of the hat 50 as possible.

Each of the outwardly extending arms 11 may have a first end 12 (FIG. 2) and a second end 13 wherein the first end 12 of the outwardly extending arms 11 are permanently connected to the center ring portion 10 and wherein the second end 13 of the outwardly extending arms 11 are free standing and not connected to anything. The outwardly extending arms 11 may extend outward from the center ring portion 10 in a generally radial pattern wherein each of the outwardly extending arms 11 roughly covers a radius of the device 1 and wherein outwardly extending arms 11 on opposing sides of the device 1 generally equal a diameter 20 (FIG. 3) of the device 1.

In an embodiment, an opening 25 may be located on at least one of the outwardly extending arms 11. The opening 25 may be a generally circular hole extending from the top 2 to the bottom 3 of the device 1 and may allow the device 1 to hang from a hook or the like when the device 1 is not in use. In addition, in an embodiment, a plurality of openings 25 may be located on the outwardly extending main arms 11. The opening 25 (and any additional openings provided on the extending arms 11) may be further used provide ventilation to the person wearing the device 1 so as to decrease the trapping of heat which may otherwise be uncomfortable.

In an embodiment, each of the outwardly extending main arms 11 may be roughly triangular in shape (having curved edges). The base of the triangular shape may be located at the second end 13 of the outwardly extending main arms 11 so that the first end 12 (the end connected to the center ring portion 10) is thinner than the second end 13. In an embodiment, the second end 13 of each of the outwardly extending main arms 11 may have a length 18 (FIG. 2) and the first end 12 of each of the outwardly extending main arms 11 may have a width 19. In an embodiment, the length 18 at the second end 13 of each of the outwardly extending main arms 11 is at least twice as big as the length 19 at the first end 12 of the same outwardly extending main arm 11 so as to allow the device 1 to properly fold into the second orientation and still cover a large surface area under the underside 51 of the hat 50.

In an embodiment, some of the outwardly extending main arms 11 may have a generally oval extension 30 located at a side 11B (FIG. 2) of the outwardly extending main arms 11. Further, in an embodiment, some of the outwardly extending main arms 11 may have two oval extensions 30 wherein each extension is located on opposing sides of the outwardly extending arms 11. The oval extensions 30 may provide additional surface area (and therein support and protection for the wearer of the device 1) when the device 1 is in use in the second orientation under a hat 50 as described below. The oval extensions 30 are generally smaller in length and size then the outwardly extending main arms 11 for which they are attached.

Figure 4:
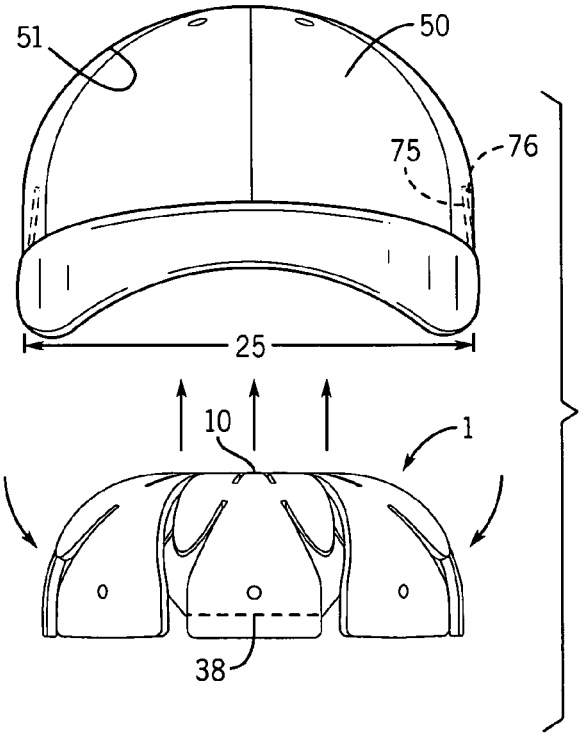
FIG. 4 illustrates a side view of the device for stabilizing a hat wherein the device is in the functional domed-shaped orientation and is in the process of being inserted into the underside of a hat.

In an embodiment, the device 1 may move from a generally flat orientation (FIG. 3) into a generally domed-shaped second orientation (FIG. 4). When the device 1 is in the generally flat orientation, the device 1 is especially suitable for storage and transportation. When the device 1 is in the domed-shaped second orientation (FIG. 4) the device 1 is suitable for use in connection with the hat 50; specifically, an underside 51 of the hat 50. More specifically, a user may generally bend the outwardly extending main arms 11 slightly downward with respect to the center ring portion 10 so that the outwardly extending main arms 11 no longer occupy the same planar surface as the center ring portion 10.

In an embodiment, the diameter 20 of the device 1 may be greater than a diameter 25 (FIG. 4) of the hat 50 so that when the device 1 is moved into the domed-shaped second orientation the overall diameter 20 of the device 1 decreases and therein substantially matches the diameter 25 of the hat 50. In the generally flat orientation, the diameter 20 of the device 1 is greater than the diameter 25 of the hat 50.

In an embodiment, the width 8 of the device 1 may be, for example, between a quarter inch and an inch and a half. It should be understood that this width 8 may vary a great deal depending on the desired application for the device 1. The width 8 should be great enough so as to be firm enough to support the underside 51 of the hat 50, but not too great wherein it becomes difficult to move the device 1 into the domed-shaped orientation. Further, the width 8 may be narrow enough so that a person may wear the hat 50 even when the device 1 is secured to the underside 51 of the hat 50.

In an embodiment, a portion of the second side 13 of the outwardly extending arms 11 may be partially secured within the underside rim 75 (FIG. 4) of the hat 50. More specifically, many hats 50 have a generally circular rim 75 which runs along the bottom interior surface of the hat 50 and for which is not visible when the hat 50 is worn. Often, a small groove 76 is therein formed between the circular rim 75 and the hat 50. In hats 50 having this feature, a portion of the second side 13 of the device 1 may easily be placed into the groove 76 of the hat 1 and the device 1 may therein be prevented from shifting with respect to the hat 50.

Figure 5:
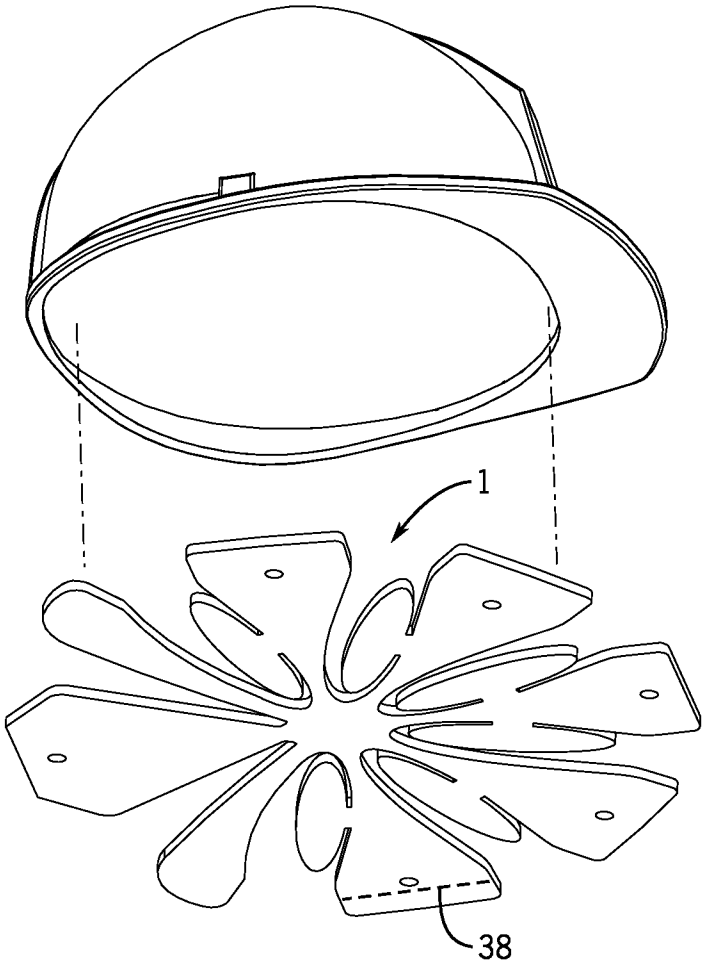
FIG. 5 illustrates the device in a generally flat orientation located under a hat.

As stated above, in an embodiment, the device 1 may be constructed of foam, cardboard or the like. As a result, a user may cut and or trim a portion of the second end 13 of the outwardly extending arms 11 to shorten the device 1 to form a smaller hat 50. As such, the device 1 may be altered to be suitable to fit almost any hat 50 including a hat 50 of a child. In particular, a perforation line 38 (FIG. 5) may be located near the second end 13 of the outwardly extending main arms 11. The perforation line 38 may allow a user to remove a portion of the outwardly extending main arms 11 so as to shorten the overall diameter 20 of the device 1 so that the device 1 may properly fit into a smaller hat 50.

In another embodiment, the top 2 of the device 1 may have a temporary adhesive 44 (FIG. 3). The adhesive 44 may allow the device 1 to be more easily secured to the underside 51 of the hat 50 so as the device 1 is less likely to accidentally shift. As a result, the user has greater protection against head injury in the event of the user suffering from contact to the head.

Figure 7:
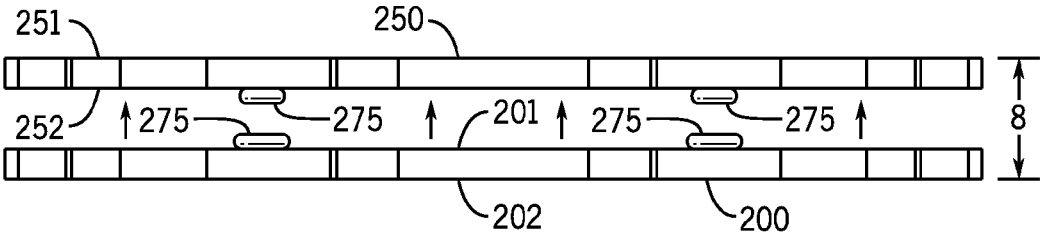
FIG. 7 illustrates an alternative embodiment of the device wherein the device has a first and second layer which are removable from each other so as to allow the user to select the overall width or thickness of the device.

Referring now to FIG. 7, in an alternative embodiment, the device 1 may have a first layer 200 and a second layer 250. In this embodiment, the first layer 200 may have a top 201 and a bottom 202. Further, in this embodiment, the second layer 250 may have a top 251 and a bottom 252. The first layer 200 and the second layer 250 may be temporarily secured to each or removed from each other so as the user may determine the overall width (or thickness) 8 of the device 1. In this embodiment, the first layer 200 and the second layer 250 may be temporarily secured to each other by, for example, a plurality of buttons 275 secured to the top 201 of the first layer 200 and the bottom 252 of the second layer 250. Allowing the user to determine the overall width or thickness 8 of the device 1 allows the user to alter the device 1 depending on, for example, comfort or the hat 50 being worn by the user.

In an alternative embodiment, a perforation line 66 (FIG. 2) may be located between the outwardly extending main arms 11 and the oval extensions 30. The peroration line 66 may allow a user to remove one or more of the oval extensions 30 to increase comfort of the device 1.

Figure 8:
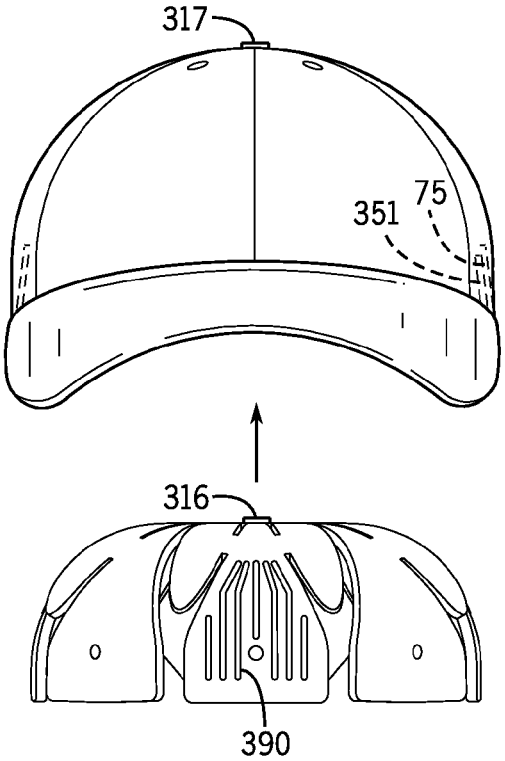
FIG. 8 illustrates an alternative embodiment of the device wherein a magnet is secured to the top surface and wherein the magnet is attracted to a button of the hat.

Referring now to FIG. 8, in an alternative embodiment, the top 2 of the device 1 may have a magnet 316. The magnet may be attracted to a button 317 which is commonly located on the top of a hat 50. As a result, the magnet 316 helps secure the device 1 within the hat 50 and prevents the device 1 from unintentionally moving within the hat 50.

Figure 9:
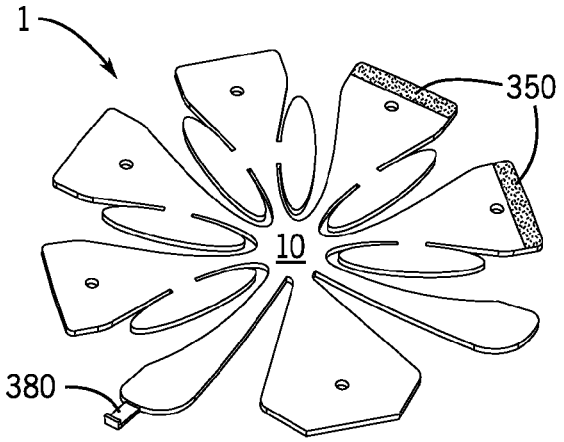
FIG. 9 illustrates alternative embodiments of the device wherein a hook and loop fastener strip is located at the distal end of the outwardly extending arms and is used to secure the device to the interior of the hat and wherein the device has a clip for securing to a hat.

Referring now to FIG. 9, in yet another alternative embodiment, the device 1 may have a hook and loop fastener strip 350. The hook and loop fastener strip 350 may be located, for example, at the second end 13 of the outwardly extending main arms 11. The hook and loop fastener strip 350 may correspondingly be temporarily secured to an opposing hook and loop fastener strip located 351 (FIG. 8) along the brim of the hat 50. Also illustrated in FIG. 9, in an embodiment, the device 1 may have a clip 380 located at the second end 13 of the outwardly extending main arms 11 wherein the clip 380 is used to secure the device 1 to the hat 50. In particular, a portion of the clip 380 grasps the hat 50 while the device 1 is in use.

Figure 6:
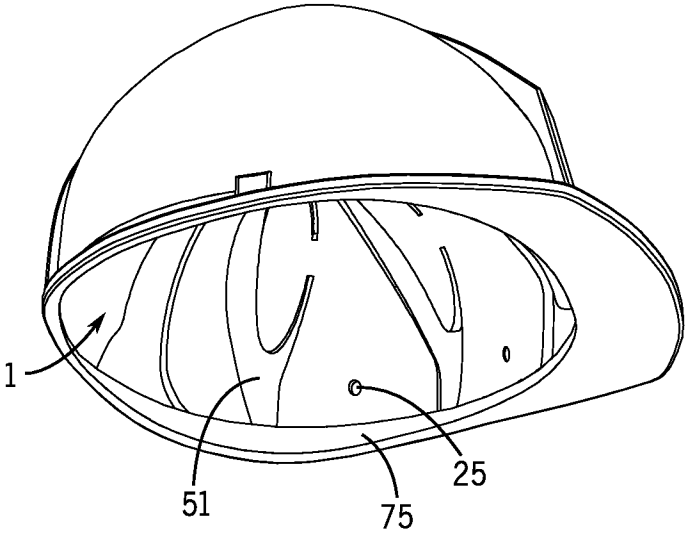
FIG. 6 illustrates the device in the functional orientation secured under a hat.
Figure 10:
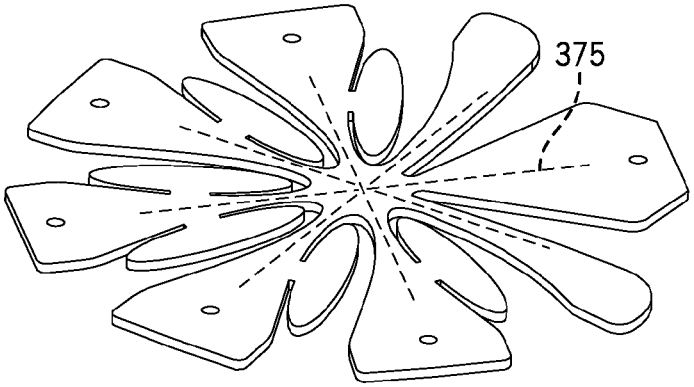
FIG. 10 illustrates an alternative embodiment wherein the device has an interior wire frame which allows the device to be moved and secured into various orientations.

Referring now to FIG. 10, is still another alternative embodiment, the device 1 may have an internal wire frame skeleton 375. More specifically, the internal wire frame skeleton 375 may be initially flat (FIG. 1) and may later be bent into the second orientation (FIG. 6). The interior wire frame skeleton 375 may be used to keep the device 1 in the desired orientation. More specifically, the internal wire frame 375 may act like a wire within a sponge wherein the shape of the sponge may be manipulated by bending the wire. Having the internal wire frame skeleton 375 may allow a user to more accurately and comfortably secure the device 1 into the proper second orientation prior to using the device under the hat 50. Even further, the interior wire frame skeleton 375 may be used as a ground (once properly connected) to protect utility works for lightning or other sources of electricity. In an embodiment, the internal wire frame skeleton 375 may be made of metal.

In an embodiment, the top 2 and/or bottom 3 of the device 1 may have a plurality of elongated ridges 390 (FIG. 8). The plurality of ridges 390 may be used to create a buffer space between the head of the user and the device 1 and also the device 1 and the hat 50. As a result, the plurality of ridges 380 improves air flow and allows the device 1 to breath in a more efficient manner. In an embodiment, the elongated ridges 390 may be generally parallel to each other.

Figure 11:
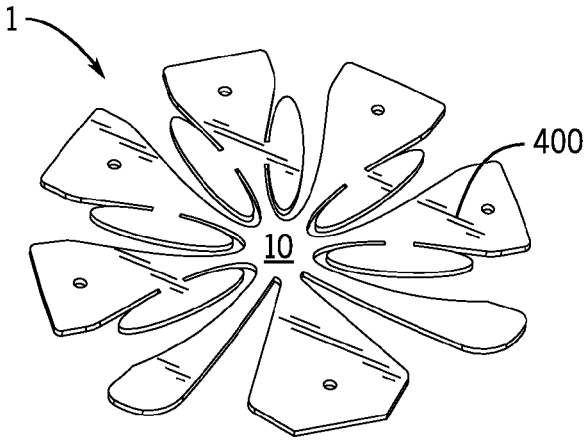
FIG. 11 illustrates an alternative embodiment of the device wherein a puncture proof shield layer is provided over the device to protect a person's head from injury as a result of a sharp object.

Finally, referring now to FIG. 11, in an embodiment, the device 1 may have a puncture proof shield layer 400. The plastic puncture proof shield layer 400 may cover the entire top 2, bottom 3 and sides of the device 1 and may prevent injury to a person's head from sharp objects. The plastic puncture proof shield layer 400 may be made from, for example, thin, 0.15 mm to 3 mm PP Non Toxic, flexible puncture proof Plastic material, or pvc material, or any type of material that can form a toughened layer over the foam insert to prevent the head from coming in contact with sharp pointy objects, forms, boards, pipes and the like.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A liner for under a hat comprising:

a first side, a second side, a front, a back, a top, a bottom and a generally circular center portion;

a plurality of radially extending main arms extending from the generally circular center portion wherein the plurality of radially extending main arms have a first end, a second end, a top, a bottom, a first side and a second side and wherein the first ends are secured to the generally circular center portion and therein the second ends of the plurality of radially extending main arms extend away from the generally circular center portion and form a generally circular circumference of the liner;

wherein the plurality of radially extending main arms comprise at least one flared radially extending main arm and at least one asymmetrical extending main arm wherein a base of the flared radially extending main arm is located at the generally circular circumference;

a generally oval extension extending out from the first side or the second side of at least one of the plurality of radially extending main arms wherein the generally oval extension has a first end, a second end, a first side and a second side and wherein the generally oval extension is not present on at least one of the plurality of radially extending main arms;

wherein the generally oval extension extends intermediary between the first end and the second end of the plurality of radially extending arms and wherein the generally oval extension is secured to the first side or the second side of the radially extending main arms at a single connection area on the first side or second side of the generally oval extension and wherein the first end and the second end of the generally oval extensions are not secured to or in contact with the plurality of radially extending main arms and therein the first end and the second end of the generally oval extension moves and bends independently from the plurality of radially extending arms; and wherein the liner is malleable and may be moved from a generally flat orientation into a generally domed-shaped orientation and wherein the liner is secured under a hat in the generally domed-shaped orientation.

2. The liner for under a hat of claim 1 further comprising:

an opening through at least one of the plurality of radially extending main arms wherein the opening extends from the top to the bottom of the plurality of radially extending main arms and wherein the opening allows for increased ventilation through the liner.

3. The liner for under a hat of claim 1 further comprising:

a perforation line at the second end of at least one of the plurality of radially extending main arms wherein the perforation line allows a portion of the second end of the plurality of radially extending main arms to be shortened so as to allow the liner to be secured in an underside of the hat.

4. The liner for under a hat of claim 1 further comprising:

an adhesive located on the top of at least one of the plurality of radially extending main arms.

5. A liner for under a hat comprising:

a first side, a second side, a front, a back, a top, a bottom and a generally circular center portion;

a plurality of radially extending main arms extending from the generally circular center portion wherein the plurality of radially extending main arms have a first end, a second end, a top, a bottom, a first side and a second side and wherein the first ends are secured to the generally circular center portion and therein the second ends of the plurality of radially extending main arms extend away from the generally circular center portion and form a generally circular circumference of the liner;

wherein the plurality of radially extending main arms comprise at least one flared radially extending main arm and at least one asymmetrical extending main arm wherein a base of the flared radially extending main arm is located at the generally circular circumference;

a generally oval extension extending out from the first side or the second side of at least one of the plurality of radially extending main arms wherein the generally oval extension has a first end, a second end, a first side and a second side and wherein the generally oval extension is not present on at least one of the plurality of radially extending main arms;

wherein the generally oval extension extends intermediary between the first end and the second end of the plurality of radially extending arms and wherein the generally oval extension is secured to the first side or the second side of the radially extending main arms at a single connection area on the first side or second side of the generally oval extension and wherein the first end and the second end of the generally oval extensions are not secured to or in contact with the plurality of radially extending main arms and therein the first end and the second end of the generally oval extension moves and bends independently from the plurality of radially extending arms;

wherein the liner is malleable and may be moved from a generally flat orientation into a generally domed-shaped orientation and wherein the liner is secured under a hat in the generally domed-shaped orientation;

a perforation line at the second end of at least one of the plurality of radially extending main arms wherein the perforation line allows a portion of the second end of the plurality of radially extending main arms to be shortened so as to allow the liner to be secured in an underside of the hat; and an adhesive located on the top of at least one of the plurality of radially extending main arms.

* * * * *